United States Patent [19]

Mankekar

[11] 4,377,133

[45] Mar. 22, 1983

[54] CRYOGENIC HEATER

[76] Inventor: Ajit D. Mankekar, 4920 S. Lewis, #107, Tulsa, Okla. 74105

[21] Appl. No.: 299,330

[22] Filed: Sep. 4, 1981

Related U.S. Application Data

[63] Continuation of Ser. No. 159,205, Jun. 13, 1980, abandoned.

[51] Int. Cl.[3] ..... F22B 1/02; F22B 7/00

[52] U.S. Cl. ..... 122/31 A; 122/32; 122/33; 122/136 R; 122/367 C

[58] Field of Search ..... 122/31 A, 51, 32–34, 122/68, 82, 106, 136 R, 138, 140 A

[56] References Cited

U.S. PATENT DOCUMENTS

| | | | |
|---|---|---|---|
| 2,642,046 | 6/1953 | Alexander | 122/33 |
| 3,315,735 | 4/1967 | Stranko | 122/32 |
| 3,597,588 | 8/1971 | Kirschner | 122/32 |
| 3,683,867 | 8/1972 | Viessmann | 122/136 R |
| 3,688,839 | 9/1972 | Kirschner | 122/33 |
| 3,805,745 | 4/1974 | Block et al. | 122/367 C |
| 3,817,219 | 6/1974 | Sweet | 122/367 C |
| 4,169,431 | 10/1979 | Viessmann | 122/136 R |
| 4,220,005 | 9/1980 | Cutts | 122/367 C |
| 4,222,350 | 9/1980 | Pompei et al. | 122/32 |

*Primary Examiner*—Henry C. Yuen

*Attorney, Agent, or Firm*—Head, Johnson & Stevenson

[57] ABSTRACT

An apparatus for heating a confined liquid medium having a closed vessel with a heat transfer liquid therein, a burner housing within the vessel submerged in the heat transfer liquid, a burner having a fuel inlet and combustion air inlet, the burner having a flame outlet communicating with the interior of the burner housing, a flue conduit connected to the burner housing at a point spaced from the burner flame outlet and extending through the vessel wall and communicating with the atmosphere, a liquid medium heat exchanger supported within the vessel above the burner housing including an inlet and outlet conduit passing through the wall of the vessel and a transfer liquid heat exchanger within the burner housing intermediate the burner flame outlet and the flue conduit including means for passing the heat transfer liquid therethrough.

5 Claims, 5 Drawing Figures

CRYOGENIC HEATER

This is a continuation application of Ser. No. 159,205, filed June 13, 1980 now abandoned.

BACKGROUND OF THE INVENTION

1. Field of the Invention

This invention relates to a device for heating a confined fluid medium and is particularly related to heating cryogenic fluids, such as liquified petroleum gas to convert it from the liquid to the gas state.

2. Description of the Prior Art

In the past, cryogenic liquids have been heated using natural draft radiant heaters. This type heater has several drawbacks primarily due to the problem of attaining sufficient heat transfer when the source of heat is in radiant form. In most cryogenic applications the process tubes are below the freezing point and a layer of ice is formed on the tubes. Ice is a very poor heat conductor. Thus, the radiant type heater is seldom used at the present time in cryogenic applications.

Convective heaters have been utilized which transfer heat by flowing tempered products of combustion over a bank of processing tubes (usually finned tubes) through which the cryogenic liquid is circulated. The convective heaters are usually of the fan recirculation, jet recirculation, or excess air type. These type heaters have proved more successful than the radiant type; however, each has certain disadvantages and are relatively expensive.

A submerged exhaust heater has been employed in which the hot products of combustion are bubbled through water to create a froth. Heat transfer tubes carrying the cryogenic fluid are submersed in the water. There are two basic problems with the submerged exhaust type heater, that is: (1) the direct contact between the products and water results in contamination of water causing it to become acidic; and (2) since the combustion has to overcome the water head, this type heater usually requires high blower horsepower compared to the other types of heating systems.

The type of heater which has proven most successful is the indirect water vat heater. A burner is fired into a tube immersed in a bath of water. Process coils are immersed in the same bath above the fire tube. The heated water rises to the top and transfers heat by natural convection to the process tubes carrying the cryogenic liquids. While this heater has proven successful, designs up to the present time have not achieved a high level of energy transfer efficiency and, in fact, the typical unit has a thermal efficiency of about 70%.

It is an object of this invention to provide an improved heater for heating cryogenic liquids such as liquified petroleum gas (LPG). This invention is directed towards an improvement in the indirect water bath heater and has the advantages of the water bath heater in that the flue gas is confined to the fire tube. The process flow coils are immersed in the water bath and are never contacted by the flue gas. In addition to these basic advantages, the present invention is a substantial improvement over the state of the art in that thermal efficiencies of as high as 95% can be attained. In these times of high energy cost and the importance of fuel conservation, the present invention is significant in achieving reduced energy consumption.

A more particular object of this invention is to provide an apparatus for heating a cryogenic liquid such as LPG in a manner wherein the heat transfer efficiency, or thermal efficiency, is greatly improved over existing type heaters.

These general objects as well as other and more specific objects of the invention will be fulfilled in the following description and claims, taken in conjunction with the attached drawings.

SUMMARY OF THE INVENTION

An apparatus for heating a confined liquid medium, such as liquified petroleum gas (LPG) is provided. The apparatus is in the form of a closed vessel, such as a horizontal tank. Formed in the vessel and communicating with one end thereof, is a burner housing. Within the vessel and surrounding the burner housing is a heat transfer liquid, such as water. A burner is utilized for providing heat energy, the burner having a fuel inlet and a combustion air inlet. The burner has a flame outlet which communicates with the interior of the burner housing, preferably through an opening in the end wall of the vessel. A flue conduit connects to the burner housing at the end thereof opposite the burner. The flue conduit extends from within the housing and through a closed opening in the vessel for exhaustion to the atmosphere. A liquid medium heat exchanger is supported within the vessel externally of the burner housing and communicates through closed openings in the vessel. A liquid medium to be heated, such as LPG, is conducted through the heat exchanger. Heat of combustion within the housing is transferred to the water medium and thereby to the heat exchanger positioned within the water medium. To increase efficiency of the unit, that is, to extract a higher percent of the heat of combustion, a transfer liquid heat exchanger is positioned within the burner housing and in front of the flue conduit. The transfer liquid heat exchanger includes a plurality of heat transfer tubes. The liquid medium within the vessel is circulated through these heat transfer tubes so that the heat of combustion of the gas of combustion passing through the transferred liquid heat exchanger is extracted.

DESCRIPTION OF THE DRAWINGS

FIG. 4 shows an alternate arrangement of the invention and provides means wherein the transfer liquid heat exchanger utilizes natural convection.

DETAILED DESCRIPTION

Figure 1:
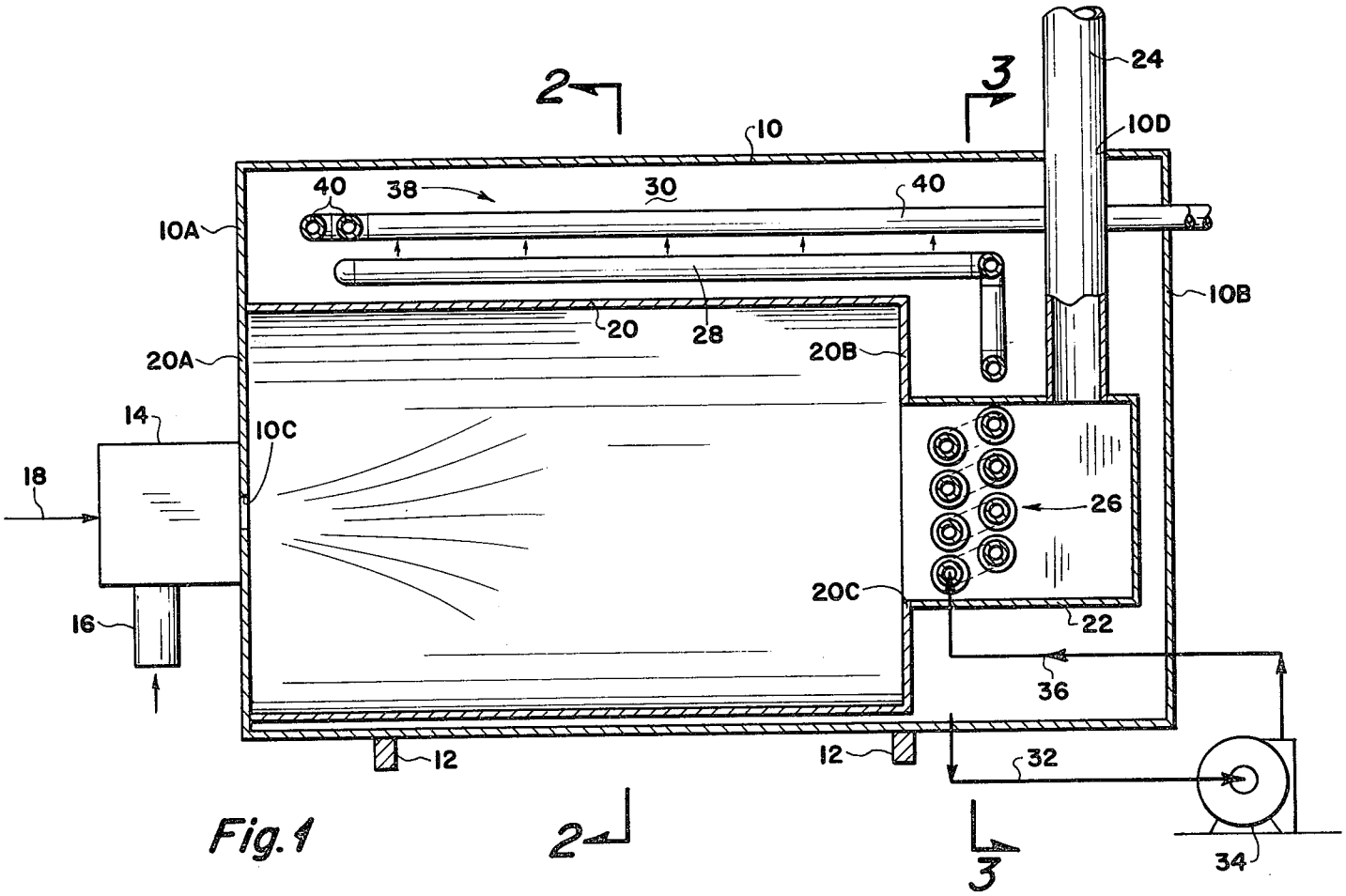
FIG. 1 is an elevational cross-sectional view of a heater for a confined liquid medium such as LPG wherein the heater is in the form of a horizontal vessel having a burner at one end.
Figure 2:
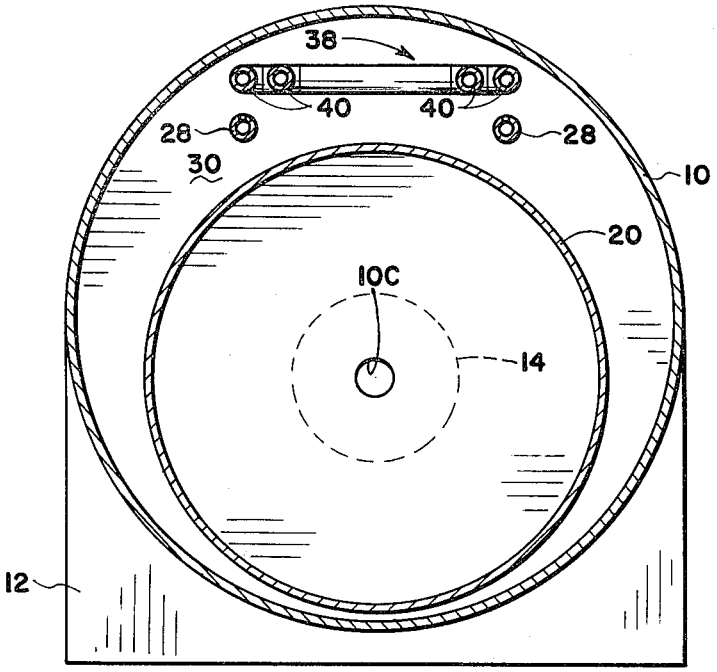
FIG. 2 is a cross-sectional view taken along the line 2—2 of FIG. 1.
Figure 3:
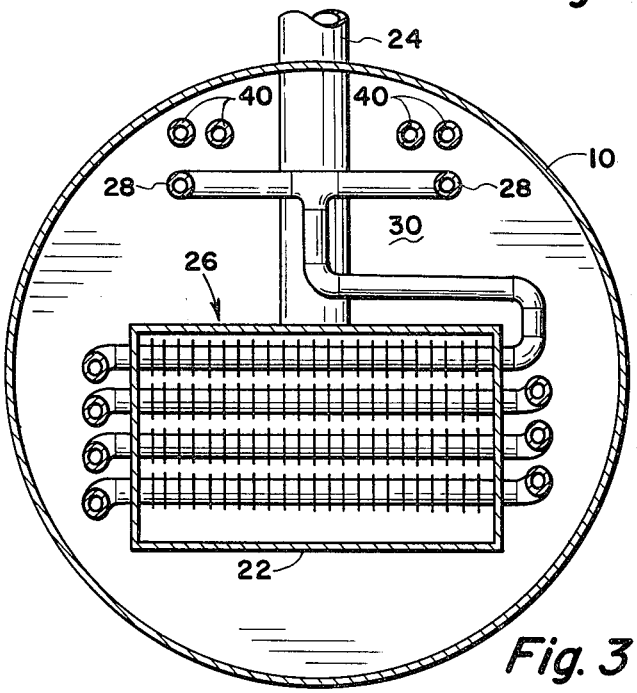
FIG. 3 is a cross-sectional view taken along the line 3—3 of FIG. 1.

Referring to the drawings and first to FIGS. 1, 2 and 3, a preferred embodiment of the invention is illustrated. The heater includes a closed vessel 10. In the illustrated arrangement vessel 10 is of a horizontal configuration, that is, it is cylindrical with the cylindrical axis being horizontal, the vessel being supported on members 12. The vessel 10 has end walls 10A and 10B. Supported on the first end wall 10A is a burner 14 which has an air inlet 16 and a fuel inlet 18. An opening 10C is formed in housing 10. Within burner 14 fuel and gas are mixed and the combustion of the gas is directed into the interior of the vessel 10. Within the vessel a burner housing 20 is placed. The housing 20 is cylindrical and has one end wall 20A which is coincident with the vessel end wall 10A. At the opposite end wall 20B of the burner housing there is an opening 20C which communicates with a flue chamber 22. Connected to the flue chamber is a flue conduit 24 which extends sealably through an opening 10D in vessel 10. The heat of combustion from burner 14 thus heats the interior of the burner housing 20 and the gases of combustion pass through the flue chamber 22 and out the flue conduit 24 to the atmosphere.

Positioned within the flue chamber 22 is a transfer liquid heat exchanger generally indicated by the numeral 26 which is in the form of looped finned tubes. Positioned above the burner housing 20 is a horizontal perforated sparging tube 28. The sparging tube is connected in series with the transfer liquid heat exchanger 26.

The interior of vessel 10 is filled with a heat transfer medium 30 such as water. In order to extract maximum heat from the combustion of fuel, water is withdrawn through a pipe 32 connected to the lower end of vessel 10 and by means of a pump 34 the water is recycled through pipe 36 which connects with the transfer liquid heat exchanger 26. The recycled water passes through the heat exchanger 26 and is discharged through outlets in sparging tube 28.

Positioned in the upper portion of the interior of vessel 10 is a liquid medium heat exchanger generally indicated by the numeral 38. In the illustrated embodiment the liquid medium heat exchanger 38 is in the form of horizontally disposed finned tubes 40 which pass out through the vessel end wall 10B. The liquid medium to be heated which, as previously indicated, may be a cryogenic liquid such as liquified petroleum gas (LPG), is passed through the length of the finned tube 40 and out of the vessel. The liquid to be heated is at all times confined within the liquid medium heat exchanger 38 and there is no contact of this liquid medium with the heat transfer medium 30 within the vessel. In like manner, there is no contact between the combustion gases confined within the burner housing 20 and the liquid medium heat exchanger 38. All of the transfer of heat from combustion within the combustion housing 20 to the liquid medium heat exchanger 38 takes place by transfer through the heat transfer medium 30, which as previously indicated, is preferably in the form of water. The heat transfer medium 30 is heated by the large are a of contact with the burner housing 20, the flue chamber 22, and the flue conduit 24. In addition, any heat of combustion which is not absorbed in the burner housing 20 is utilized to provide heat exchange by transfer liquid heat exchanger 26 as the flue gas is passed therethrough on the way to flue conduit 24. This substantially increases the thermal efficiency of the unit and, in practical application, a thermal efficiency as high as 95% has been attained.

To further increase the heat transfer from the heat of combustion to the cryogenic liquids flowing through the liquid medium heat exchanger 38, the circulation of water by pump 34 extracts heat from the transfer liquid heat exchanger 26 and delivers it out through sparging tube 38. This circulation of water and delivery through the perforated sparging tube causes turbulence around the liquid medium heat exchanger 38. Further, with proper operating parameters, the heat transfer medium water delivered by pump 34 can be controlled at a rate such that in the transfer liquid heat exchanger 26 the water is at least partially converted to steam. This steam is discharged through perforated sparging tube 28 to further cause agitation of the water around the liquid medium heat exchanger 38 and even further increase the effectiveness of heat transfer from the liquid medium to the cryogenic fluid flowing through the finned tubes 40. Chilled liquid such as LPG absorbs heat as it flows through the heat exchanger 38 and is transformed from a liquid to a gas. The gas passes out and is thereby usable as a gaseous fuel which does not have to be stored at low temperatures. Thus the heater performs the objective of the invention as set forth, that is, it provides a means of heating a cryogenic liquid in a manner wherein the efficiency of heat transfer of the fuel of combustion to the cryogenic liquid is greatly increased. Further, the heater of this invention has the advantage that all of the heat transfer takes place by means of the liquid medium 30. There is no contact of the products of combustion with the heat transfer medium 30, so it is not contaminated and therefore does not have to be replaced nor chemically treated.

ALTERNATE EMBODIMENT

Figure 4:
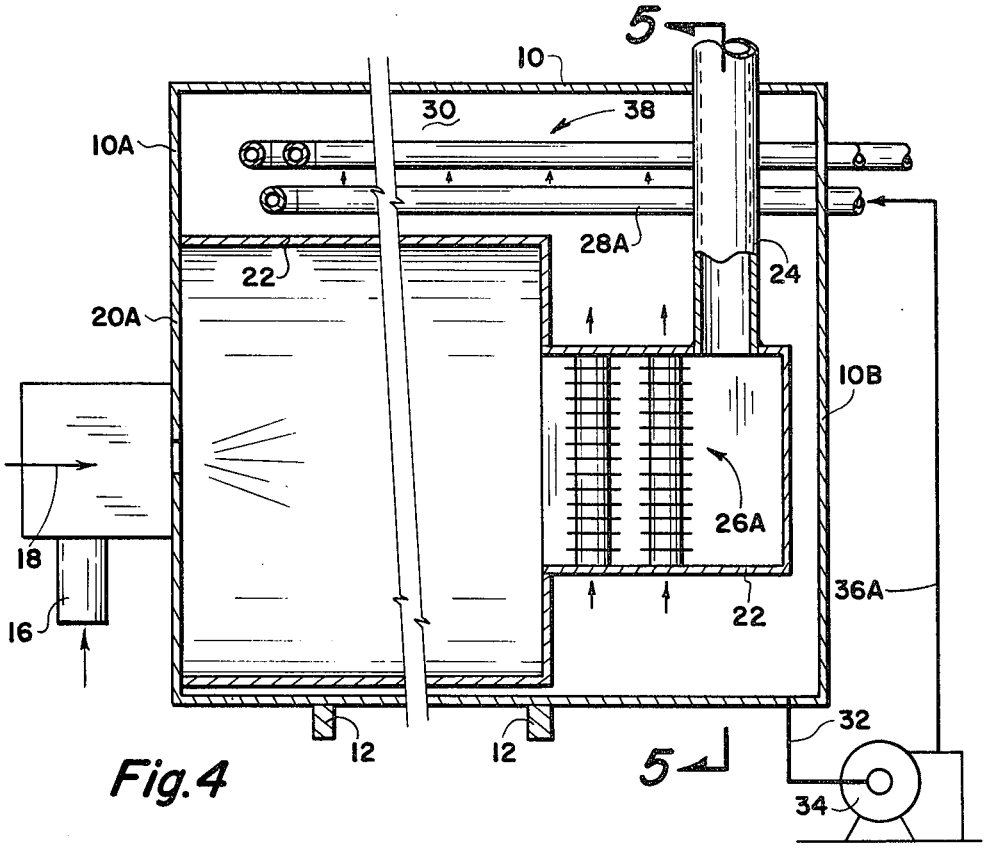
FIG. 4 is an elevational cross-sectional view, shown broken away in the center to reduce the illustrated length thereof.
Figure 5:
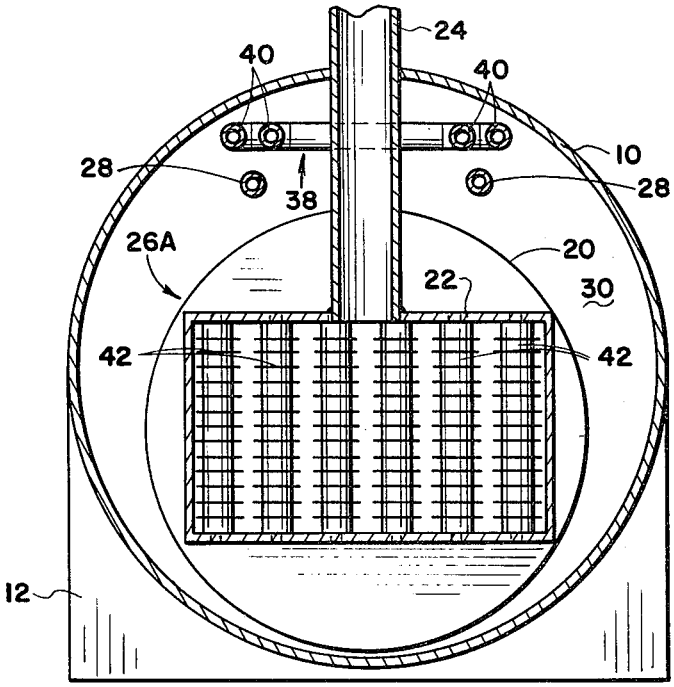
FIG. 5 is a cross-sectional view of the alternate embodiment taken along the line 5—5 of FIG. 4.

Referring to FIGS. 4 and 5, an alternate arrangement of the invention is shown. The invention is essentially the same as that described with reference to FIGS. 1, 2 and 3 except for the difference in the arrangement of the transfer liquid heat exchanger. In the alternate arrangement the heat transfer medium 30 is induced to flow through the transfer liquid heat exchanger 26A by natural convection rather than by use of a pump as in the first described embodiment. For this purpose, the transfer liquid heat exchanger 26A is in the form of a plurality of finned tubes 42 which are arranged vertically within the flue chamber 22. Each of the finned tubes 42 communicates through an opening at the top and bottom of the flue chamber so that liquid medium 30 is free to pass upwardly through the tubes 42. As flue gas flows past the heat exchanger 26A, heating tubes 42, this heat is transferred to the water therein, causing the heated water to rise and thus inducing natural convection.

As an additional alternate arrangement, outlet pipe 36A from pump 34 may be connected directly to sparging tube 28A. Pump 34 circulates heat transfer medium from the interior of the vessel 10 and discharges it beneath the liquid medium heat exchanger 38. This causes turbulence to increase the effectiveness of heat transfer to the cryogenic liquids flowing into the heat exchanger 38.

Both embodiments of the invention as set forth herein achieve highly improved thermal efficiency by providing a maximum extraction of the heat available from the combustion of gas in the burner housing 20. A substantial portion of any heat remaining which would otherwise pass out to the atmosphere through the flue conduit 24 is extracted in the transfer liquid heat exchanger 26 or 26A and conducted to the heat transfer medium 30.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element or step thereof is entitled.

What is claimed is:

1. Apparatus for heating a confined liquid medium comprising:

a closed vessel having a heat transfer liquid therein;

a burner housing within said vessel at least substantially submerged to said heat transfer liquid;

a burner having a fuel inlet and combustion air inlet, the burner having a flame outlet communicating with the interior of said burner housing;

a flue conduit connected to said burner housing at a point spaced from said burner flame outlet, the flue conduit extending sealably through the vessel wall and communicating with the atmosphere;

a liquid medium heat exchanger in the form of at least one elongated horizontal conduit supported within the upper portion of said vessel externally of said burner housing including inlet and outlet conduits passing sealably through the wall of said vessel;

a transfer liquid heat exchanger within said burner housing intermediate said burner flame outlet and said flue conduit, including at least one inlet and outlet passing sealably through the wall of said burner housing including means of circulating the heat transfer liquid therethrough;

a pump having an inlet and outlet, the inlet having communication with said vessel; and a sparging tube positioned adjacent, parallel to, and below the liquid medium heat exchanger, the sparging tube being in the form of at least one elongated horizontal perforated tube and being connected to receive and discharge the flow of heat transfer medium from said pump.

2. An apparatus according to claim 1 wherein said liquid medium heat exchanger is in the form of an elongated horizontal finned tube.

3. An apparatus according to claim 1 wherein said burner housing is a horizontally disposed vessel having said burner outlet at one end thereof including a flue chamber extending therefrom at the opposite end, said flue conduit being connected to said flue chamber, and said transfer liquid heat exchanger being positioned within the flue chamber.

4. An apparatus according to claim 3 wherein said liquid medium heat exchanger is in the form of a plurality of tubes positioned within said flue chamber, each tube having a lower inlet opening and an upper outlet opening, both of which communicate with the heat transfer liquid.

5. Apparatus according to claim 1 wherein said transfer liquid heat exchanger is in the form of a plurality of vertical tubes each of which has the lower inlet end and the upper outlet end communicating through openings in said flue chamber.

* * * * *